US010988297B2

(12) United States Patent
Yamada

(10) Patent No.: US 10,988,297 B2
(45) Date of Patent: Apr. 27, 2021

(54) BAG-IN-BOX

(71) Applicant: FUJIMORI KOGYO CO., LTD., Tokyo (JP)

(72) Inventor: Toshio Yamada, Tokyo (JP)

(73) Assignee: FUJIMORI KOGYO CO., LTD., Tokyo (JP)

( * ) Notice: Subject to any disclaimer, the term of this patent is extended or adjusted under 35 U.S.C. 154(b) by 0 days.

(21) Appl. No.: 16/111,302

(22) Filed: Aug. 24, 2018

(65) Prior Publication Data

US 2019/0084743 A1 Mar. 21, 2019

(30) Foreign Application Priority Data

Sep. 15, 2017 (JP) ..... JP2017-177700

(51) Int. Cl.
*B65D 77/06* (2006.01)
*B65D 65/40* (2006.01)

(52) U.S. Cl.
CPC ..... *B65D 77/065* (2013.01); *B65D 65/403* (2013.01)

(58) Field of Classification Search
CPC ..... B65D 77/065; B65D 65/403; B65D 88/1618; B65D 77/06; B65D 90/046; B65D 31/10; B32B 27/08; B32B 27/32
USPC ..... 229/117.3; 383/120, 109, 116, 105; 220/495.06; 206/216; 222/105, 183
See application file for complete search history.

(56) References Cited

U.S. PATENT DOCUMENTS 5,213,253 A * 5/1993 Fantoni ..... A45C 7/0036 229/117
5,279,440 A * 1/1994 Fougeres ..... B65D 77/0426 220/288
5,429,264 A * 7/1995 Hollander ..... B65D 25/16 229/103.11
5,788,121 A * 8/1998 Sasaki ..... B65D 77/065 222/105
2005/0220369 A1* 10/2005 Sullivan, Jr. ..... B65D 75/563 383/22
2008/0267538 A1* 10/2008 Stephenson ..... B65D 25/16 383/33

FOREIGN PATENT DOCUMENTS

| | | | |
|---|---|---|---|
| CN | 1130144 | A | 9/1996 |
| CN | 1154935 | A | 7/1997 |
| EP | 0769523 | B1 | 1/2003 |
| GB | 2295373 | A | 5/1996 |
| JP | H07-017567 | A | 1/1995 |
| JP | H7-8263 | U | 2/1995 |
| JP | H8-48342 | A | 2/1996 |

(Continued)

OTHER PUBLICATIONS

Extended European Search Report for European Patent Application No. 18189674.7 dated Jan. 17, 2019; 8 pgs.

(Continued)

*Primary Examiner* — Christopher R Demeree
(74) *Attorney, Agent, or Firm* — Hauptman Ham, LLP

(57) ABSTRACT

Provided is a novel bag-in-box having a small load on the environment. A bag-in-box includes a box body including a corrugated cardboard as a forming material, and a flexible inner bag that is accommodated in the interior of the box body, in which the inner bag is formed of a material containing a biomass-derived polyolefin resin.

3 Claims, 4 Drawing Sheets

(56) References Cited

FOREIGN PATENT DOCUMENTS

| | | | |
|---|---|---|---|
| JP | H8-142283 | A | 6/1996 |
| JP | H09-169359 | A | 6/1997 |
| JP | 2000-335640 | A | 12/2000 |
| JP | 2002-225942 | A | 8/2002 |
| JP | 2006-341876 | A | 12/2006 |
| JP | 4125493 | B2 | 7/2008 |
| JP | 2012-1235 | A | 1/2012 |
| JP | 2012-251006 | A | 12/2012 |
| JP | 2013-151623 | A | 8/2013 |
| JP | 2014-046674 | A | 3/2014 |
| JP | 2014-69456 | A | 4/2014 |
| JP | 2015-96431 | A | 5/2015 |
| JP | 6101851 | B1 | 3/2017 |
| JP | 6111367 | B1 | 4/2017 |
| JP | 6111368 | B1 | 4/2017 |
| JP | 6175178 | B1 | 8/2017 |
| JP | 6175179 | B1 | 8/2017 |
| WO | 2014006269 | A1 | 1/2014 |

OTHER PUBLICATIONS

Office Action for European Patent Application No. 18189674.7 dated Mar. 2, 2020, 4 pgs.

Office Action for Japanese Patent Application No. 2017-177700 dated Nov. 28, 2017 and English translation thereof; 8 pgs.

Notice of Allowance for Japanese Patent Application No. 2017-177700 dated Mar. 13, 2018 and English translation thereof; 5 pgs.

Office Action for Japanese Patent Application No. 2018-000278 dated Jul. 24, 2018 and English translation thereof; 8 pgs.

Notice of Allowance for Japanese Patent Application No. 2018-000278 dated Nov. 6, 2018 and English translation thereof; 5 pgs.

Office Action for European Patent Application No. 18189674.7 dated Oct. 22, 2020; 5 pgs.

Office Action for Chinese Patent Application No. 201810985277.2 dated Dec. 3, 2020 and English summary thereof; 4 pgs.

* cited by examiner

BAG-IN-BOX

CROSS-REFERENCE TO RELATED APPLICATIONS

This application claims the priority from Japanese Patent Application No. 2017-177700 (filing date: Sep. 15, 2017). The entire teachings of the above application are incorporated herein by reference.

BACKGROUND OF THE INVENTION

(1) Field of the Invention

The present invention relates to a bag-in-box.

(2) Description of Related Art

A bag-in-box is widely utilized for storing and transporting liquid products (beverages, car oils, detergents, medicaments, and the like) in various fields such as food industry, automobile industry, pharmaceutical industry, and toiletry industry. Such a bag-in-box is composed of an outer box such as a corrugated cardboard box that is selected in view of necessary rigidity for transportation or preservation, and a bag body made of a synthetic resin that accommodates liquid products in an inner side thereof (for example, Japanese Patent No. 4125493).

SUMMARY OF THE INVENTION

Meanwhile, for the purpose of reducing a use amount of petroleum resources, aliphatic polyesters such as polylactic acid, polyhydroxybutyric acid, polycaprolactone, and polybutylene succinate have been developed. Furthermore, since ethylene as a raw material monomer is obtained from biomass, biomass polyethylene (plant-derived polyethylene) has a smaller load on the environment than petroleum-derived polyethylene, and since biomass polyethylene has quality close to that of petroleum-derived polyethylene, it has been attracting attention.

However, an attempt to use biomass polyethylene as a material for a bag body of a bag-in-box has been hardly made.

The present invention has been made in view of such circumstances, and provides a novel bag-in-box having a small load on the environment.

In order to solve the above-mentioned problems, one aspect of the present invention provides a bag-in-box comprising: a box body including a corrugated cardboard as a forming material; and a flexible inner bag accommodated in an interior of the box body, in which the inner bag is formed of a material containing a biomass-derived polyolefin resin.

One aspect of the present invention may be configured that the inner bag includes as a forming material a laminate having at least a sealant layer, adhering between the sealant layers to provide a bag shape, the inner bag comprises one pair of planar sections constituting a front part and a rear part, and one pair of side sections held between the one pair of planar sections, the one pair of side sections has turnback sites protruding into an inner side of the inner bag, the planar sections and the side sections are composed of the laminate, and are sealed to abutting parts between the one pair of planar sections and the one pair of side sections facing each other at four sides of the planar sections, the sealant layer included in the planar sections and the sealant layer included in the side sections are sealed at the abutting parts, and the sealant layers include the biomass-derived polyolefin resin.

One aspect of the present invention may be configured that the laminate has an outer laminate and an inner laminate positioned in an inner side of the outer laminate, the outer laminate has an outer sealant layer that is the sealant layer, the inner laminate has an inner sealant layer that is the sealant layer, and any one or both of the outer sealant layer and the inner sealant layer include(s) the biomass-derived polyolefin resin.

One aspect of the present invention may be configured that in the inner sealant layer, a first inner sealant layer, a second inner sealant layer, and a third inner sealant layer are laminated in that order from an inner side of the inner bag, the first inner sealant layer includes a petroleum-derived polyolefin resin, and a material for forming the second inner sealant layer has a biomass degree of 50% or more and 100% or less.

One aspect of the present invention may be configured that the third inner sealant layer includes a petroleum-derived polyolefin resin.

One aspect of the present invention may be configured that the outer laminate includes a substrate layer on a face on an outer side of the outer sealant layer; and an adhesive layer between the outer sealant layer and the substrate layer, and in the outer sealant layer, a first outer sealant layer, a second outer sealant layer, and a third outer sealant layer are laminated in that order from a side of the substrate layer, the first outer sealant layer includes a petroleum-derived polyolefin resin, and a material for forming the second outer sealant layer has a biomass degree of 50% or more and 100% or less.

One aspect of the present invention may be configured that the third outer sealant layer includes a petroleum-derived polyolefin resin.

One aspect of the present invention may be configured that the inner bag comprises one pair of container parts, an edge part of an opening of one of the container parts is sealed to an edge part of an opening of another of the container parts facing the one of the container parts, and pushing the one of the container parts into a more inner side than an abutting part between the edge part of the opening of the one of the container parts and the edge part of the opening of the other of the container parts enables folding into an inner side of the inner bag.

One aspect of the present invention may be configured that the bag-in-box has an inlet joined to the inner bag, and the inlet includes as a forming material a polyolefin resin having a biomass degree of 40% or more and 100% or less.

According to one aspect of the present invention, there is provided a novel bag-in-box having a small load on the environment.

DETAILED DESCRIPTION OF THE INVENTION

First Embodiment

Hereinafter, a bag-in-box according to a first embodiment of the present invention will be described with reference to the drawings. In the following all drawings, the dimension and ratio of each element are appropriately altered in order to make it easy to see the drawings.

<<Bag-in-Box>>

Figure 1:
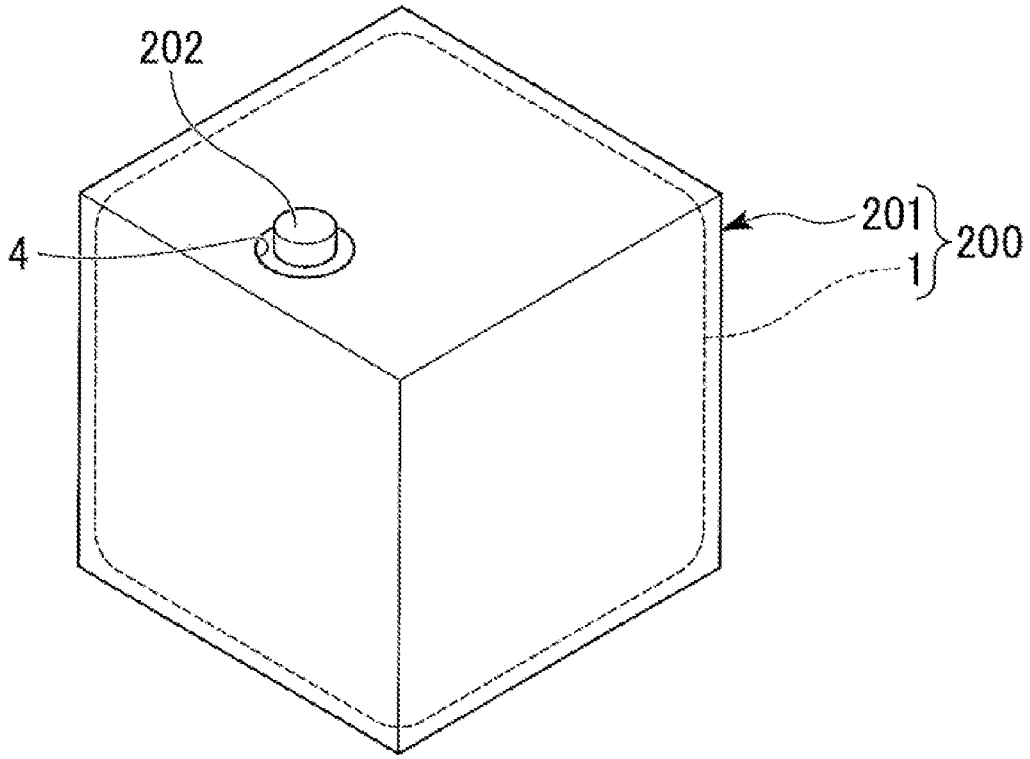
FIG. 1 is a perspective view showing a bag-in-box 200 of a first embodiment.

FIG. 1 is a perspective view showing a bag-in-box 200 of the present embodiment. As shown in FIG. 1, the bag-in-box 200 of the present embodiment comprises a box body 201, an inner bag 1, and an inlet 4.

<Box Body>

The box body 201 shown in FIG. 1 has a rectangular parallelepiped shape. The box body 201 of the present embodiment has a space capable of accommodating the inner bag 1 in the interior thereof. At an upper portion of the box body 201 shown in FIG. 1, an insertion hole 202 is provided. The box body 201 of the present embodiment includes a corrugated cardboard as a forming material.

<Inner Bag>

The inner bag 1 of the present embodiment is accommodated in the interior of the box body 201. The inner bag 1 of the present embodiment has a space capable of accommodating a content in the interior thereof.

The content to be accommodated in the inner bag 1 of the present embodiment is not particularly limited, but examples thereof include medicines, cells, tissues, organs, biomaterials, bloods, body fluids, enzymes, antibodies, beauty products, nutrients, health agents, cosmetics, foods, and the like.

Additionally, the specific state shape, and the like of the content to be accommodated in the inner bag 1 of the present embodiment is not particularly limited. The above-mentioned content may be, for example, solid, liquid, gas, powder, particle, mixture, composition, dispersion or the like. Additionally, when the above-mentioned content is liquid, the liquid may be an aqueous solution containing a medicament. When the above-mentioned content is accommodated in the inner bag 1, an inert gas such as nitrogen may be accommodated therein.

When the content to be accommodated in the inner bag 1 of the present embodiment is liquid, the inner bag 1 with the content accommodated therein is supported on an inner surface of the box body 201, and is expanded into a rectangular parallelepiped shape that is similar to the shape of the box body 201.

<Inlet>

The inlet 4 of the present embodiment is joined to the inner bag 1. The inlet 4 is exposed to the outside of the box body 201 from the insertion hole 202 included in the box body 201.

The inlet 4 of the present embodiment can be molded by an injection molding method using a polyolefin resin. The polyolefin resin used as a raw material of the inlet 4 is preferably polyethylene. From the viewpoint of reducing the load on the environment, a biomass degree of the polyolefin resin is preferably 40% or more. The biomass degree of the polyolefin resin can be 100% or less, and is preferably 90% or less. Additionally, from the viewpoint of moldability in injection molding, the biomass degree of the polyolefin resin used as a raw material of the inlet 4 is preferably 80% or less.

In the present specification, as a biomass degree, a value measured in accordance with ASTM D6866 is used. In the above-mentioned measurement, biomass-derived carbon and fossil fuel-derived carbon are discriminated from each other. The biomass-derived carbon contains radioactive carbon ($C^{14}$). On the other hand, in the fossil fuel-derived carbon, radioactive carbon ($C^{14}$) has decreased to a detection limit or lower. For that reason, the biomass-derived carbon and the fossil fuel-derived carbon can be discriminated from each other by the presence or absence of the radioactive carbon ($C^{14}$). When the radioactive carbon ($C^{14}$) concentration of the biomass-derived carbon is known, the content of the biomass-derived carbon can be calculated by measuring the concentration of the radioactive carbon ($C^{14}$) contained in an object to be measured.

Figure 2:
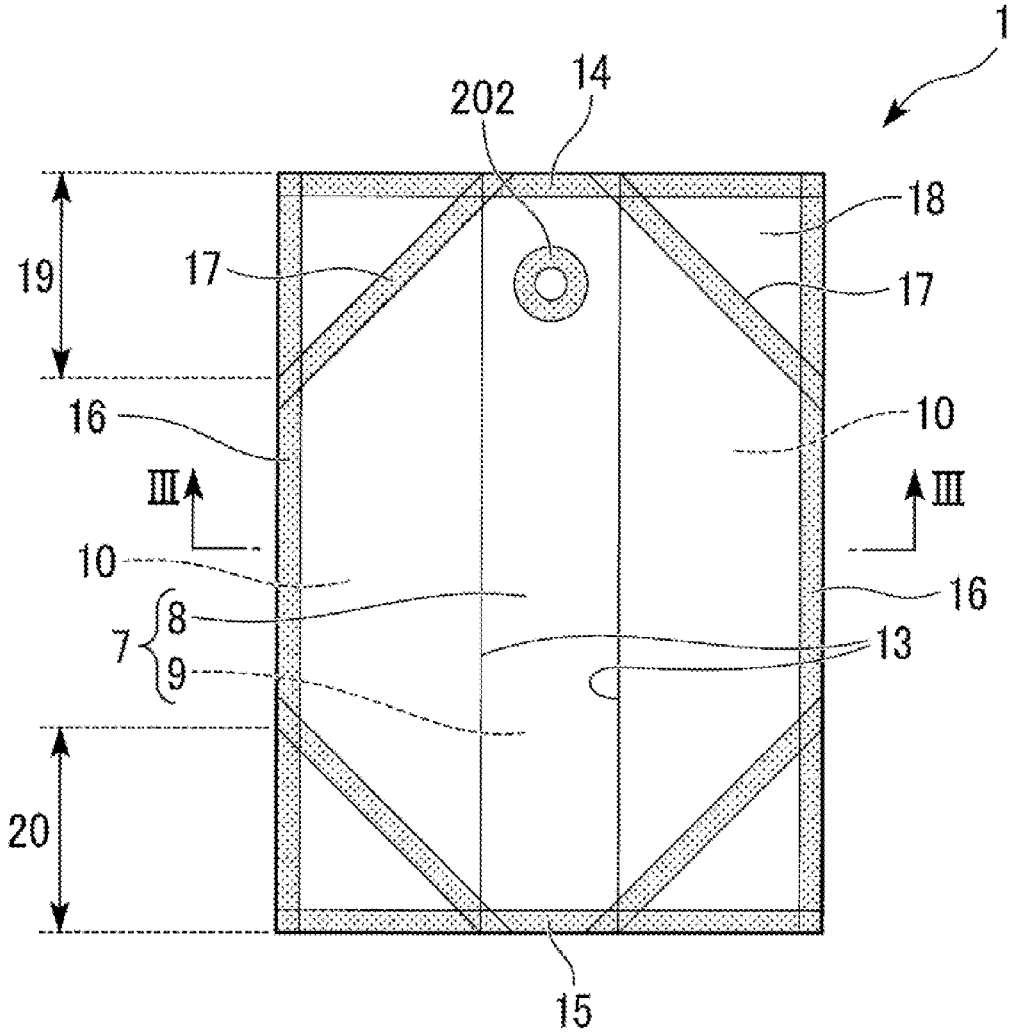
FIG. 2 is a plane view showing a state before a content is accommodated into an inner bag 1 of the first embodiment.
Figure 3:
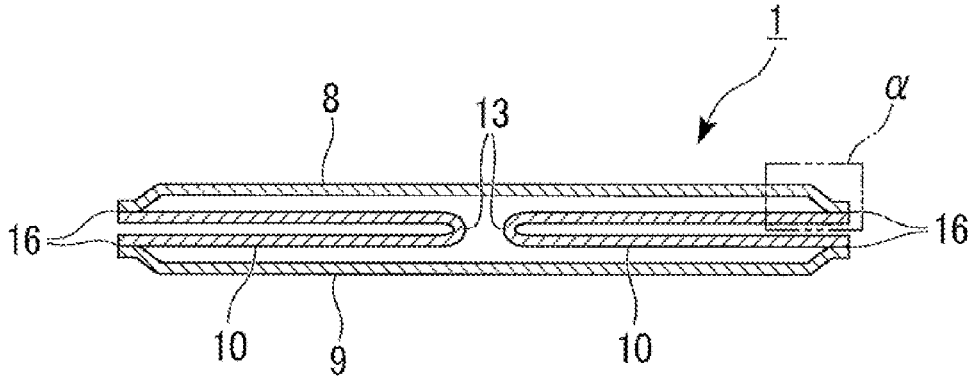
FIG. 3 is a cross-sectional view along line III-III in FIG. 2.

FIG. 2 is a plane view showing the state before the content is accommodated into the inner bag 1 of the present embodiment. FIG. 3 is a cross-sectional view along III-III line in FIG. 2. The inner bag 1 of the present embodiment is formed of a material containing a biomass-derived polyolefin resin. The inner bag 1 of the present embodiment has flexibility, and can be stored in the folded state prior to use.

The inner bag 1 of the present embodiment comprises one pair of planar sections 7 and one pair of side sections 10. The one pair of planar sections 7 constitutes a front part 8 and a rear part 9. The one pair of side sections 10 is held between the one pair of planar sections 7. In the one pair of side sections 10, turnback sites 13 that are a gusset protrude to an inner side of the inner bag 1. The planar sections 7 and the side sections 10 shown in FIG. 2 each have a rectangular shape. Generally, the inner bag 1 having the turnback sites 13 that are a gusset may be referred to as a "gusset bag".

At four sides of the planar sections 7, abutting parts between the one pair of planar sections 7 and the one pair of side sections 10 facing each other are sealed. Each of the abutting parts of four sides of the planar sections 7 is sealed, and a top sealing part 14, a bottom sealing part 15, and a side sealing part 16 are formed. Each sealing part is formed by a heat sealing method.

"Sealed" as used herein means being thermally fused and joined.

At each corner part of a top side 19 and a bottom side 20 of the inner bag 1, a straight oblique sealing part 17 obliquely crossing the corner part is formed. Additionally, at each corner part, a triangular fin part 18 is formed integrally with the oblique sealing part 17, by being surrounded by any sealing part of the top sealing part 14 and the bottom sealing part 15, the side sealing part 16, and the oblique sealing part 17. Since an internal space of this fin part 18 is completely isolated from an internal space of the inner bag 1 by the oblique sealing part 17, the accommodated content does not enter the internal space of the fin part 18.

This oblique sealing part 17 is formed by linearly sealing the facing inner surfaces of the inner bag 1, from arbitrary position of the top sealing part 14 or the bottom sealing part 15 to arbitrary position of the side sealing part 16. This oblique sealing part 17 has the function of guiding the content to a mounting portion of the inlet 4. Furthermore, the oblique sealing part 17 also has the function of accommodating the content in the box body 201 by bringing the shape of the inner bag 1 after accommodation of the content into a shape close to a rectangular parallelepiped, the function of imparting self-standing to the inner bag 1, and the function of dispersing an impact stress loaded to the inner bag 1 to improve impact resistance of the inner bag 1.

<Laminate>

Figure 4:
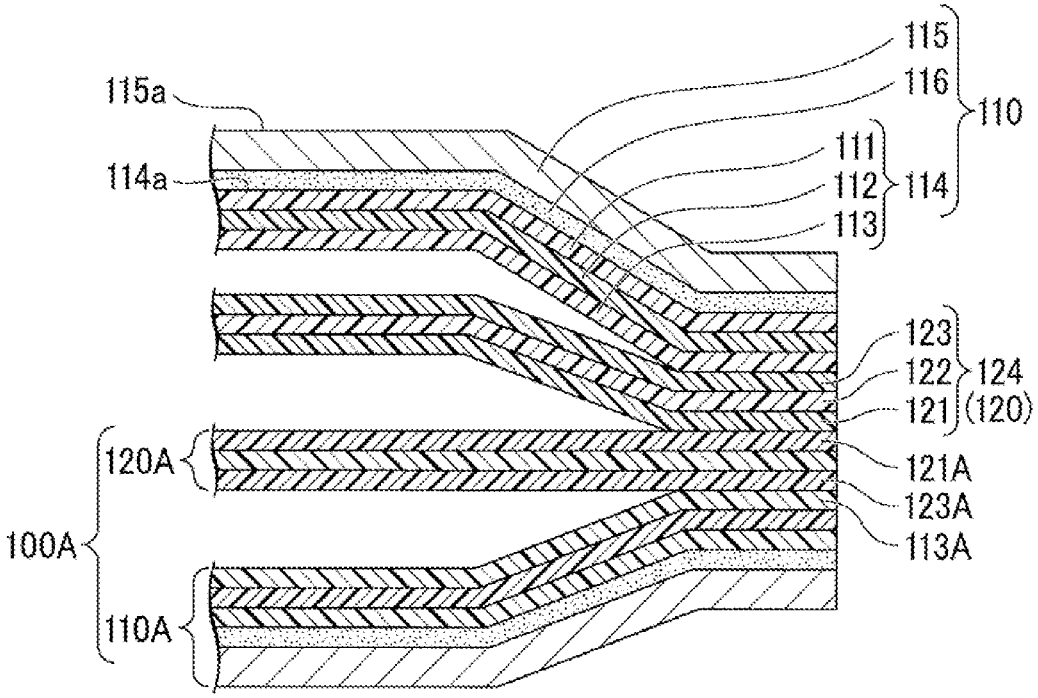
FIG. 4 is an enlarged view of a shown in FIG. 3.

The planar section 7 of the present embodiment is formed of a laminate 100. FIG. 4 is an enlarged view of a shown in FIG. 3. FIG. 4 shows a layer configuration of the laminate 100 at the planar section 7.

As shown in FIG. 4, the laminate 100 has an outer laminate 110 and an inner laminate 120. At the side sealing part 16 that is an abutting part of four sides of the planar section 7, the outer laminate 110 and the inner laminate 120 are brought into the state where they are sealed. Additionally, at the central part of the planar section 7, the outer laminate 110 and the inner laminate 120 are overlapped in the state where they do not adhere. The inner bag 1 in which two films (outer laminate 110, inner laminate 120) are overlapped in the state where they do not adhere may be referred to as "double bag". In addition, similarly at the top sealing part 14, the bottom sealing part 15, and the oblique sealing part 17, the outer laminate 110 and the inner laminate 120 are brought into the state where they are sealed.

[Outer Laminate]

The outer laminate 110 of the present embodiment has an outer sealant layer 114, a substrate layer 115 on a face 114*a* on an outer side of the outer sealant layer 114, and an adhesive layer 116 between the outer sealant layer 114 and the substrate layer 115. In addition, the outer laminate of the present invention is not limited to this, and the substrate layer and the adhesive layer can be omitted.

In the present specification, the "outer sealant layer 114" corresponds to the "sealant layer" in claims.

(Substrate Layer)

The substrate layer 115 of the present embodiment enhances the strength of the inner bag 1 of the present embodiment. It is preferable that the substrate layer 115 of the present embodiment includes a resin such as a polyester resin such as polyethylene terephthalate (PET), a polyamide resin such as nylon (Ny), and polypropylene (PP).

The substrate layer 115 may have a monolayer configuration consisting of one layer, or may have a lamination configuration of two or more layers. A layer which may constitute the substrate layer 115 (hereinafter, referred to as "other layer") can be appropriately selected. Examples of the other layer include a reinforcing layer, a gas barrier layer, a light shielding layer, and the like. The other layer can be configured not to include fluorine-based resin.

Examples of the reinforcing layer include reinforcing resin layers including biaxially stretched polyethylene terephthalate (O-PET), biaxially stretched nylon (O-Ny), biaxially stretched polypropylene (OPP), and the like.

The gas barrier layer can be constituted of, for example, an inorganic material, a gas barrier resin or the like. Examples of the inorganic material include metal-deposited layers and metal oxides such as alumina. Examples of the gas barrier resin include an ethylene-vinyl alcohol copolymer (EVOH), vinylidene chloride, and the like. Additionally, an aluminum foil can also be used in the gas barrier layer.

The light shielding layer is a colored layer. Examples of the color of the light shielding layer include white, black, gray, red, brown, blue, and the like. The light shielding layer may contain coloring matters exhibiting these colors. As the coloring matters, for example, pigments and dyes can be used.

The laminate 100 may have a printing layer or a coating layer on a face 115*a* on an outer side of the substrate layer 115.

The printing layer can impart discriminability and design property to the inner bag 1, by printing ink on a surface (face 115*a*) of the substrate layer 115.

(Adhesive Layer)

The adhesive layer 116 of the present embodiment makes the outer sealant layer 114 adhere to the substrate layer 115. It is preferable that the adhesive layer 116 of the present embodiment includes an anchoring agent such as polyurethane-based, polyether-based, and alkyl titanate (organotitanium compound)-based anchoring agents, or an adhesive resin such as an acid-modified polyolefin. Inter alia, it is preferable that the adhesive layer 116 includes a polyurethane-based resin from the viewpoint of adhesiveness.

(Outer Sealant Layer)

In the outer sealant layer 114 of the present embodiment, a first outer sealant layer 111, a second outer sealant layer 112, and a third outer sealant layer 113 are laminated in that order from the substrate layer 115 side. Additionally, each sealant layer is formed of a polyolefin resin and is preferably formed of polyethylene.

The first outer sealant layer 111 of the present embodiment is a layer that adheres to the substrate layer 115 with the adhesive layer 116 interposed between the first outer sealant layer 111 and the substrate layer 115. It is preferable that the first outer sealant layer 111 of the present embodiment includes a petroleum-derived polyolefin resin. Thereby, adhesiveness of the first outer sealant layer 111 to the substrate layer 115 can be improved. From the viewpoint of adhesiveness, the first outer sealant layer 111 and the third outer sealant layer 113 can also have a biomass degree of 50% or less, 30% or less, 10% or less, or 0%. At that time, the content of the petroleum-derived polyolefin (degree of petroleum derivation) is 50% or more, 70% or more, 90% or more, or 100%, and corresponds to each biomass degree.

The second outer sealant layer 112 of the present embodiment functions as an intermediate layer positioned between the first outer sealant layer 111 and the third outer sealant layer 113. The film thickness of the second outer sealant layer 112 is the thickness that is preferably 20% or more, more preferably 30% or more, and further can even be 40% or more of the film thickness of the outer sealant layer 114. It is preferable that the polyolefin resin as a material for forming the second outer sealant layer 112 of the present embodiment has a biomass degree of 50% or more and 100% or less. When the biomass degree of the above-mentioned polyolefin resin is 50% or more, a use amount of petroleum resources can be reduced, and the load on the environment can be reduced. Furthermore, from the viewpoint that the environmental load can be reduced, the biomass degree of the above-mentioned polyolefin resin is preferably 80% or more and is also preferably 100%.

Furthermore, when the biomass degree of the above-mentioned polyolefin resin is 50% or more, the laminate 100 having flexibility is obtained as compared with a laminate composed of a petroleum-derived polyolefin. Accordingly, the inner bag 1 obtained from the laminate 100 becomes easily handleable.

The third outer sealant layer 113 of the present embodiment is a layer that is sealed to the inner laminate 120 described later, at an abutting part which exists at four sides of the planar section 7. It is preferable that the third outer sealant layer 113 of the present embodiment includes a petroleum-derived polyolefin resin. Thereby, the adhesiveness of the third outer sealant layer 113 to the inner laminate 120 can be improved.

[Inner Laminate]

The inner laminate 120 of the present embodiment is positioned inside of the outer laminate 110. The inner laminate 120 of the present embodiment has an inner sealant layer 124. In the present specification, the "inner sealant layer 124" corresponds to the "sealant layer" in claims.

In the inner sealant layer 124 of the present embodiment, a first inner sealant layer 121, a second inner sealant layer 122, and a third inner sealant layer 123 are laminated in that order from an inner side of the inner bag 1 of the present embodiment. Additionally, each sealant layer is formed of a polyolefin resin and is preferably formed of polyethylene.

The first inner sealant layer 121 of the present embodiment is a layer that is sealed to one pair of side sections 10. It is preferable that the first inner sealant layer 121 of the present embodiment includes a petroleum-derived polyolefin resin. Thereby, the adhesiveness of the first inner sealant layer 121 to the one pair of side sections 10 can be improved.

The second inner sealant layer 122 of the present embodiment functions as an intermediate layer positioned between the first inner sealant layer 121 and the third inner sealant layer 123. It is preferable that a polyolefin resin as a material for forming the second inner sealant layer 122 of the present embodiment has a biomass degree of 50% or more and 100% or less. When the biomass degree of the above-mentioned polyolefin resin is 50% or more, a use amount of petroleum resources can be reduced, and the load on the environment can be reduced. Furthermore, from the viewpoint that the environmental load can be reduced, it is preferable that the biomass degree of the above-mentioned polyolefin resin is 80% or more.

Furthermore, when the biomass degree of the above-mentioned polyolefin resin is 50% or more, the laminate 100 having flexibility is obtained as compared with a laminate composed of a petroleum-derived polyolefin. Accordingly, the inner bag 1 obtained from the laminate 100 becomes easily handleable.

The third inner sealant layer 123 of the present embodiment is a layer that is sealed to the third outer sealant layer 113 of the outer laminate 110, at an abutting part which exists at four sides of the planar section 7. When the third outer sealant layer 113 of the present embodiment includes a biomass-derived polyolefin resin, it is preferable that the third inner sealant layer 123 includes a petroleum-derived polyolefin resin. Thereby, the adhesiveness of the third inner sealant layer 123 to the third outer sealant layer 113 can be improved.

In addition, when the third outer sealant layer 113 of the present embodiment includes a petroleum-derived polyolefin resin, the third inner sealant layer 123 may include a petroleum-derived polyolefin resin or may include a biomass-derived polyolefin resin. Since the adhesiveness between the third outer sealant layer 113 and the third inner sealant layer 123 can be improved, it is more preferable that both the third outer sealant layer 113 and the third inner sealant layer 123 include a petroleum-derived polyolefin resin.

At an abutting part between four sides of the planar section 7, and the planar section 7 and the side section 10 facing each other, the third outer sealant layer 113 and the third inner sealant layer 123 included in the planar section 7, and the third outer sealant layer 113 and the third inner sealant layer 123 included in the side section 10 are sealed.

The layer configuration of the laminate 100 at the planar section 7 has been illustrated above. In addition, the side section 10 comprises a laminate 100A having a similar layer configuration to that of the laminate 100.

As shown in FIG. 4, at the side sealing part 16 that is an abutting part of four sides of the planar section 7, the inner laminate 120 at the planar section 7 and an inner laminate 120A at the side section 10 are arranged opposite to each other, and the third inner sealant layer 123 of the inner laminate 120 and a third inner sealant layer 123A of the inner laminate 120A are sealed. Additionally, an outer laminate 110A at the side section 10 and the inner laminate 120A at the side section 10 are arranged opposite to each other, and a third outer sealant layer 113A of the outer laminate 110A and a first inner sealant layer 121A of the inner laminate 120A are sealed. Thereby, the inner bag 1 of the present embodiment is formed into a bag shape.

According to the first embodiment, there is provided a novel bag-in-box having a small load on the environment.

Second Embodiment

Hereinafter, a bag-in-box according to a second embodiment of the present invention will be described with reference to the drawings. In the second embodiment, the same symbols are given to elements in common with the first embodiment, and detailed description will be omitted.

<<Bag-in-Box>>

Figure 5:
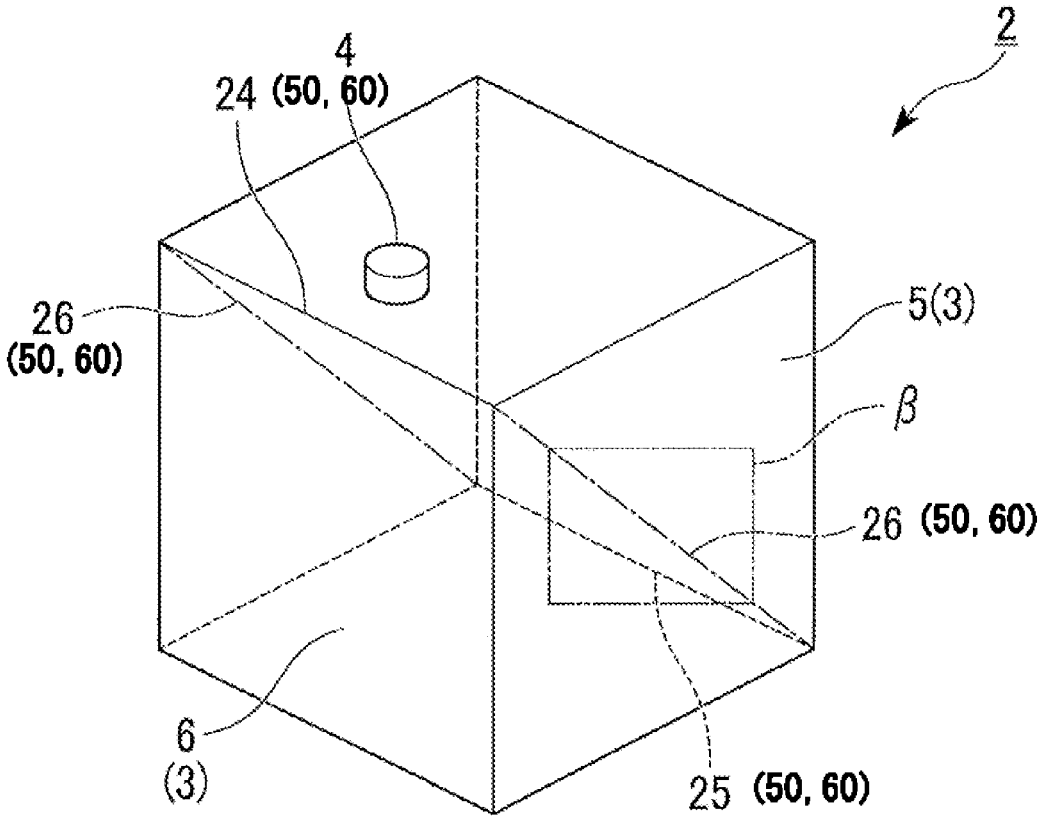
FIG. 5 is a perspective view showing an inner bag 2 of a second embodiment.

A bag-in-box of the second embodiment has an inner bag 2 in place of the inner bag 1 of the first embodiment. FIG. 5 is a perspective view showing the inner bag 2 of the present embodiment.

<Inner Bag>

The inner bag 2 of the present embodiment has a space capable of accommodating a content in the interior thereof. The content that is accommodated in the inner bag 2 of the present embodiment is similar to that of the first embodiment.

The inner bag 2 of the present embodiment is an inner bag obtained by adhering monolayered resin molded products having ruggedness. The inner bag 2 may have a rugged structure with a height of 0.01 mm or more and 2.0 mm or less on an outer surface. Thereby, the inner bag 2 of the present embodiment is easily grasped and the inner bag 2 is easily handled.

As shown in FIG. 5, the inner bag 2 of the present embodiment comprises one pair of container parts 3. The one pair of container parts 3 constitutes an upper container part 5 and a lower container part 6. The upper container part 5 has an inlet 4.

An edge part 50 of an opening of the upper container part 5 is sealed to an edge part 60 of an opening of the facing lower container part 6.

The inner bag 2 of the present embodiment is a resin molded product formed from a biomass-derived polyolefin resin, and the biomass-derived polyolefin resin is preferably a biomass-derived polyethylene.

It is preferable that a biomass degree of a material for forming the inner bag 2 is 40% or more and 100% or less. When the biomass degree of the above-mentioned material for formation is 40% or more, the inner bag 2 having flexibility is obtained as compared with an inner bag composed of a petroleum-derived polyolefin. Accordingly, the inner bag 2 becomes easily handleable. Additionally, when the biomass degree of the above-mentioned material for formation is 40% or more, components having a low biomass degree easily bleed out onto a surface, and the friction between the box body 201 composed of a corrugated cardboard and the inner bag 2 becomes small. The inner bag 2 is easily taken into and out of the box body 201 due to the effect derived from such a material for formation and the effect derived from the above-mentioned rugged structure.

The inner bag 2 of the present embodiment has flexibility, and can be stored in the folded state prior to use. Specifically, pushing one container part 3 (for example, lower container part 6) into a side of the other container part 3 (for example, upper container part 5) farther than an imaginary plane including an upper side portion sealing part 24, a bottom side portion sealing part 25, and a diagonal portion sealing part 26 enables folding into an inner side of the inner bag 2. In the state where the inner bag 2 is folded, the upper side portion sealing part 24, the bottom side portion sealing part 25, and the diagonal portion sealing part 26 are mountain-folded.

In the present specification, the upper side portion sealing part 24, the bottom side portion sealing part 25, and the diagonal portion sealing part 26 each correspond to an abutting part.

According to the second embodiment, there is provided a novel bag-in-box having a small load on the environment, as in the first embodiment.

In addition, the inner bag according to the present invention is not limited to the above-mentioned embodiment, and may be an inner bag in which a laminate having at least a sealant layer is included as a forming material, and adhering of sealant layers provides a bag shape.

Additionally, the inner bag 1 according to the present invention is not limited to the above-mentioned embodiment, and it is preferable that any one or both of the outer sealant layer 114 and the inner sealant layer 124 include(s) a biomass-derived polyolefin resin. Thereby, the bag-in-box according to the present invention can reduce a use amount of petroleum resources and can reduce the load on the environment.

DESCRIPTION OF THE REFERENCE NUMERALS

1, 2: inner bag
3: container part
4: inlet
7: planar section
8: front part
9: rear part
10: side section
13: turnback site
100, 100A: laminate
110, 110A: outer laminate
111: first outer sealant layer
112: second outer sealant layer
113, 113A: third outer sealant layer
114: outer sealant layer
114*a*, 115*a*: face
115: substrate layer
116: adhesive layer
120, 120A: inner laminate
121, 121A: first inner sealant layer
122: second inner sealant layer
123, 123A: third inner sealant layer
124: inner sealant layer
200: bag-in-box
201: box body

What is claimed is:

1. A bag-in-box comprising:

a box body including a corrugated cardboard as a forming material;

a flexible inner bag accommodated in an interior of said box body; and an inlet joined to said inner bag, wherein said inner bag is formed of a material containing a biomass-derived polyolefin resin, said inlet is formed of a polyolefin resin having a biomass degree of 40% or more and 100% or less, said inner bag includes a laminate having at least a sealant layer as a forming material, said inner bag comprises one pair of planar sections constituting a front part and a rear part, and one pair of side sections held between said one pair of planar sections, said one pair of side sections has turnback sites protruding into an inner side of said inner bag, said planar sections and said side sections each have a rectangular shape, abutting parts between said one pair of planar sections and said one pair of side sections facing each other are sealed at four sides of said planar sections, an oblique sealing part is formed at each corner part of a top side and a bottom side of said inner bag, a triangular fin part is formed at each corner part, an internal space of said fin part is completely isolated from an internal space of said inner bag by said oblique sealing part, said laminate has an outer laminate and an inner laminate positioned in an inner side of said outer laminate, said inner laminate has an inner sealant layer that is said sealant layer, in said inner sealant layer, a first inner sealant layer, a second inner sealant layer, and a third inner sealant layer are laminated in that order from said inner side of said inner bag, said first inner sealant layer comprises a petroleum-derived polyolefin resin, a material for forming said second inner sealant layer has a biomass degree of 50% or more and 100% or less, said third inner sealant layer comprises a petroleum-derived polyolefin resin, said outer laminate has an outer sealant layer that is said sealant layer, said outer laminate includes a substrate layer on a face on an outer side of said outer sealant layer, and an adhesive layer between said outer sealant layer and said substrate layer, said adhesive layer includes a polyurethane-based resin, in said outer sealant layer, a first outer sealant layer, a second outer sealant layer, and a third outer sealant layer are laminated in that order from a side of said substrate layer, said first outer sealant layer comprises a petroleum-derived polyolefin resin, a material for forming said second outer sealant layer has a biomass degree of 50% or more and 100% or less, and said third outer sealant layer includes a petroleum-derived polyolefin resin.

2. The bag-in-box according to claim 1, wherein adhering between said sealant layers provides a bag shape, said planar sections and said side sections are composed of said laminate, and are sealed to said abutting parts between said one pair of planar sections and said one pair of side sections facing each other at said four sides of said planar sections, said sealant layer included in said planar sections and said sealant layer included in said side sections are sealed at said abutting parts, and said sealant layers comprise said biomass-derived polyolefin resin.

3. The bag-in-box according to claim 1, wherein said inner bag comprises one pair of container parts, an edge part of an opening of one of said container parts is sealed to an edge part of an opening of another of said container parts facing the one of said container parts, and pushing the one of said container parts into a more inner side than an abutting part between the edge part of the opening of the one of said container parts and the edge part of the opening of the other of said container parts enables folding into an inner side of said inner bag.

* * * * *